US005848787A

United States Patent [19]

Miki

[11] Patent Number: 5,848,787

[45] Date of Patent: Dec. 15, 1998

[54] SHEET FEEDING DEVICE FOR AN IMAGE FORMING APPARATUS

[75] Inventor: Katsuhiko Miki, Ichikawa, Japan

[73] Assignee: Ricoh Company, Ltd., Tokyo, Japan

[21] Appl. No.: 877,505

[22] Filed: Jun. 17, 1997

[30] Foreign Application Priority Data

Jun. 21, 1996 [JP] Japan ..... 8-161491

[51] Int. Cl.[6] ..... B65H 1/08

[52] U.S. Cl. ..... 271/127; 271/160; 271/170; 271/171

[58] Field of Search ..... 271/22, 25, 149, 271/127, 152, 153, 160, 169, 170, 171

[56] References Cited

U.S. PATENT DOCUMENTS 5,758,250 5/1998 Miki ..... 271/160

FOREIGN PATENT DOCUMENTS 0262355 10/1988 Japan ..... 271/127
5-270667 10/1993 Japan .
406087540A 3/1994 Japan ..... 271/171
6-80253 3/1994 Japan .

*Primary Examiner*—H. Grant Skaggs
*Attorney, Agent, or Firm*—Oblon, Spivak, McClelland, Maier & Neustadt, P.C.

[57] ABSTRACT

A sheet feeding device for an image forming apparatus of the present invention includes a sheet sustaining portion for sustaining a stack of sheets loaded on a bottom plate. Even when a great number of sheets are stacked on the bottom plate, the sustaining portion reduces a load to act on the bottom plate and thereby prevents the bottom plate and sheets from warping or sinking. This allows a pick-up roller to press the sheet stack with an adequate force and feed the sheets stably one by one.

3 Claims, 3 Drawing Sheets

SHEET FEEDING DEVICE FOR AN IMAGE FORMING APPARATUS

BACKGROUND OF THE INVENTION

The present invention relates to a sheet feeding device for use in a copier, printer, facsimile apparatus or similar image forming apparatus.

A typical type of sheet feeding device for the above application has a tray including a bottom plate sequentially elevatable in accordance with the consumption of sheets stacked thereon. When the device is mounted to an image forming apparatus, a pick-up roller disposed in the apparatus is pressed against the uppermost sheet of the stack by a constant pressure.

However, the problem with the above conventional sheet feeding device is that when a great number of sheets are stacked on the bottom plate, the plate and sheets are apt to warp or sink. In this condition, the pick-up roller pressed against the uppermost sheet is likely to exert an excessive pressure and feed two or more sheets at the same time. Further, when the pressure of the pick-up roller is cancelled after the feed of a single sheet, the bottom plate and sheets having been pressed slightly downward by the pick-up roller rise toward their original positions. However, the force raising the bottom plate and sheets is so weak, the plate and sheets rise slowly. Therefore, when the sheets are continuously fed from the device, the uppermost sheet fails to reach an adequate sheet feed position before the next sheet feed. This prevents the pick-up roller to exert the expected pressure on the uppermost sheet and is likely to prevent the roller from feeding the sheet.

SUMMARY OF THE INVENTION

It is therefore an object of the present invention to provide a sheet feeding device for an image forming apparatus and capable of preventing, when a great number of sheets are stacked on its tray, the tray and sheets from warping or sinking so as to maintain the pressure of a pick-up roller adequate, and thereby obviating the defective sheet feed discussed above.

A sheet feeding device of the present invention includes a tray, a bottom plate mounted on the tray and rotatable in the up-and-down direction with a stack of sheets loaded thereon, and a pick-up roller pressed against the uppermost sheet of the stack for feeding the uppermost sheet. An elevating mechanism sequentially raises the bottom plate as the number of the sheets on the bottom plate decreases. A sheet sustaining portion contacts and sustains the lowermost sheet of the stack. The sheet sustaining portion is located at substantially the center in the widthwise direction of the sheets in the vicinity of the center of rotation of the bottom plate.

BRIEF DESCRIPTION OF THE DRAWINGS

The above and other objects, features and advantages of the present invention will become apparent from the following detailed description taken with the accompanying drawings in which.

In the drawings, identical reference numerals designate identical structural elements.

DESCRIPTION OF THE PREFERRED EMBODIMENTS

Figure 1A:
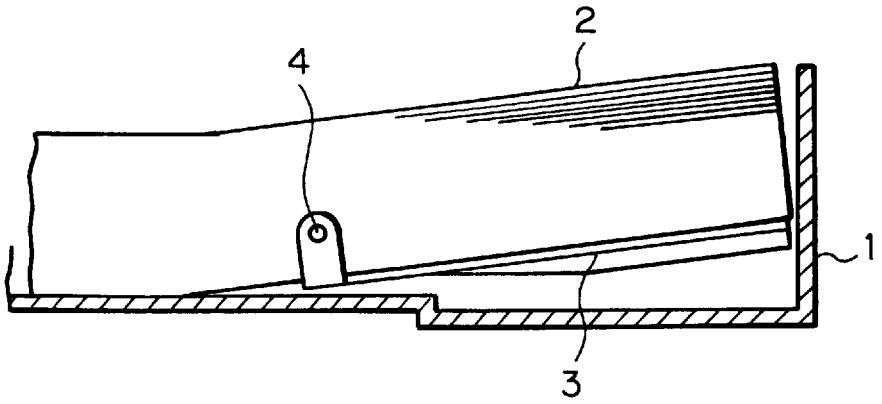
Fig. 1A PRIOR ART
FIG. 1A is a vertically sectioned side elevation of a conventional sheet feeding device and demonstrating how a bottom plate and sheets warp or sink.

To better understand the present invention, brief reference will be made to a conventional sheet feeding device for an image forming apparatus, shown in FIGS. 1A and 1B. As shown, the sheet feeding device has a tray and a bottom plate 3 disposed in the tray 1. The bottom plate 3 is loaded with a stack of sheets 2 and rotatable up and down about a shaft 4. An elevating mechanism including a spring is arranged between the tray 1 and the bottom plate 3, although not shown in FIGS. 1A and lB. When the number of sheets 2 sequentially decreases due to repeated image formation, the elevating mechanism causes the bottom plate 3 to rise about the shaft 4.

Figure 1B:
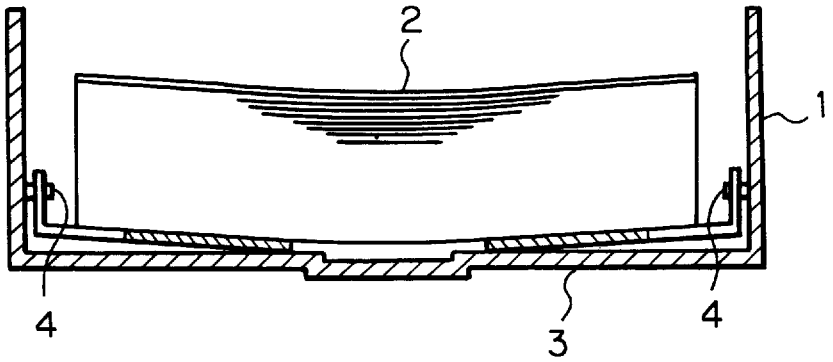
Fig. 1B PRIOR ART
FIG. 1B is a vertically sectioned front view showing the conventional sheet feeding device.

As shown in FIG. 1B, when a great number of sheets 2 exist on the bottom plate 3, the plate 3 and sheets 2 warps, or sinks, around the portion where the center line of the stack 2 in the widthwise direction and the center of rotation of the plate 3 intersect each other. In this condition, when a pick-up roller, not shown, having a semicircular cross-section is brought into contact with the uppermost sheet 2, the roller exerts an excessive pressure on the sheet 2 and tends to feed two or more sheets together. Further, such a pressure acting between the pick-up roller and the sheet 2 forces the bottom plate 3 and stack 2 slightly downward. As a result, when the pressure is cancelled after the feed of a single sheet 2, the bottom plate 3 and stack 2 are raised toward their original positions. However, the force raising the bottom plate 3 and stack 2 is so weak, the plate 3 and stack 2 rise slowly. Therefore, when the sheets 2 are continuously fed from the device, the uppermost sheet 2 fails to reach an adequate sheet feed position before the next sheet feed. This prevents the pick-up roller from exerting the expected pressure on the uppermost sheet 2 and is likely to prevent the roller from feeding the sheet 2. In this manner, in the condition shown in FIG. 1B, the pick-up roller is apt to repeatedly feed two or more sheets together and then fail to feed any sheet when the sheets 2 should be continuously fed.

Figure 2A:
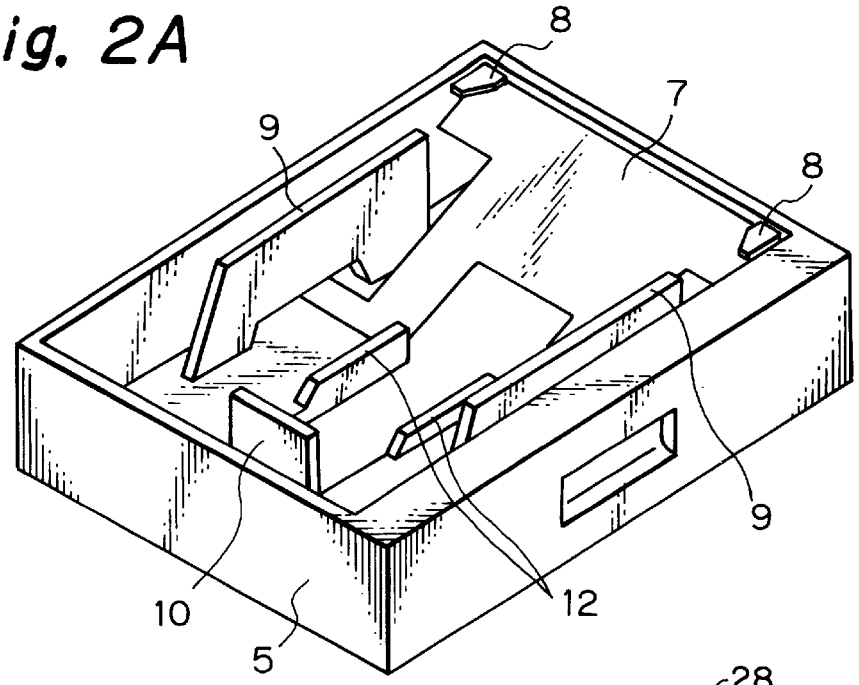
FIG. 2A is a perspective view showing a sheet feeding device embodying the present invention.
Figure 2B:
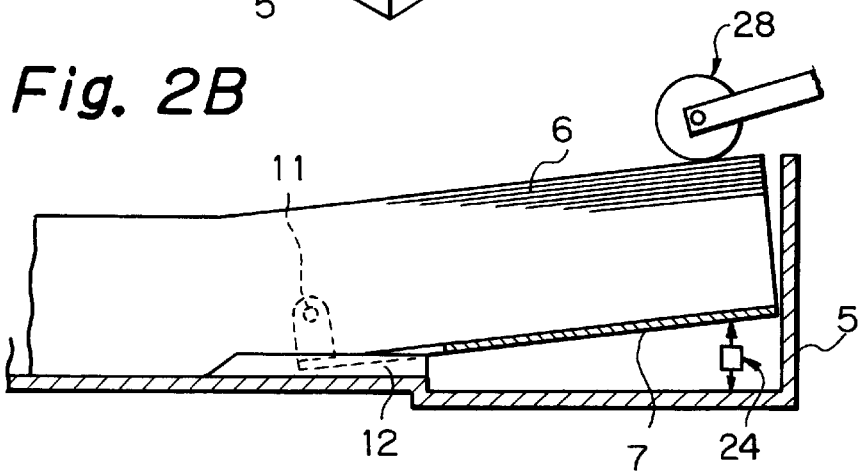
FIG. 2B is a vertically sectioned side elevation of the embodiment shown in FIG. 2A.
Figure 2C:
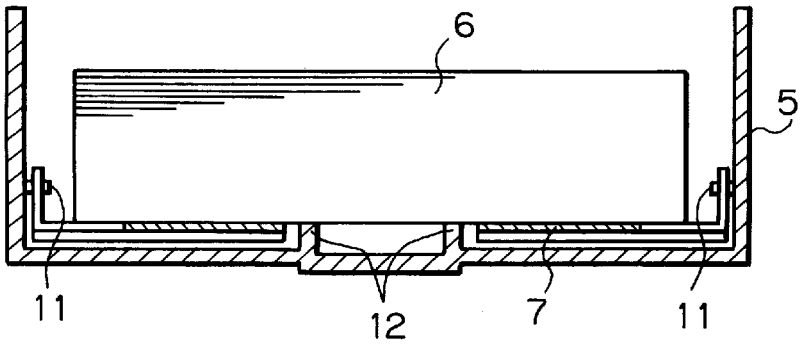
FIG. 2C is a vertically sectioned front view of the embodiment shown in FIG. 2A.

Referring to FIGS. 2A–2C, a sheet feeding device embodying the present invention will be described. As shown, the sheet feeding device includes a tray 5 removably mounted to a printer, facsimile apparatus or similar image forming apparatus not shown. Arranged in the tray 5 are a bottom plate 7, a pair of corner pieces 8, a pair of side fences 9, and an end fence 10. The bottom plate 7 is loaded with a stack of sheets 6 and rotatable up and down about a shaft 11. The corner pieces 8 separate the uppermost sheet 6 to be fed from the other sheets 6. An elevating mechanism 24 including a spring is interposed between the tray 5 and the bottom plate 7. When the number of sheets existing on the bottom plate 7 decreases due to repeated image formation, the elevating mechanism 24 causes the plate 7 to rise about the shaft 11. The side fences 9 are slidable toward and away from each other and can be fixed at any desired positions. The end fence 10 is slidable in a direction of sheet feed and can be fixed at any desired position. A pick-up roller 28 having a semicircular cross-section is disposed in the apparatus. When the tray 5 is set at a preselected position in the apparatus, the pick-up roller 28 is pressed against the stack 6 on the bottom plate 7.

A sheet sustaining portion 12 protrudes upward from the bottom of the tray 5 at substantially the center in the widthwise direction of the sheets 6 perpendicular to the direction of sheet feed and in the vicinity of the center of rotation of the bottom plate 7. The sustaining portion 12 contacts and sustains the bottom of the stack 6 loaded on the bottom plate 7. The sustaining portion 12 should preferably have a height of 2 mm to 3 mm above the bottom of the tray 5. This height may be suitable selected in matching relation to, e.g., the size of the tray 5.

In the above configuration, when a great number of sheets 6 are stacked on the bottom plate 7, the underside of the lowermost sheet 6 is brought into contact with and sustained by the sheet sustaining portion 12. In this condition, the load of the stack 6 on the bottom plate 7 partly acts on the sustaining portion 12. Therefore, the load acting on the bottom plate 7 decreases despite the number of sheets 6 existing on the plate 7. As a result, the bottom plate 7 and stack 6 are held in a substantially horizontal position as shown in FIG. 2C. This is contrastive to the sunk position discussed with reference to FIG. 1B.

Specifically, when the pick-up roller 28 is pressed against the uppermost sheet 6, the roller exerts an adequate pressure on the sheet 6 and can feed it smoothly. Moreover, although the pick-up roller 28 forces the bottom plate 7 and stack 6 slightly downward at the time of sheet feed, the bottom plate 7 free from the warp shown in FIG. 1B rises immediately when the pressure is cancelled. The embodiment therefore insures stable sheet feed, i.e., obviates the simultaneous feed of two or more sheets and the failure of sheet feed even during continuous sheet feed.

Figure 3:
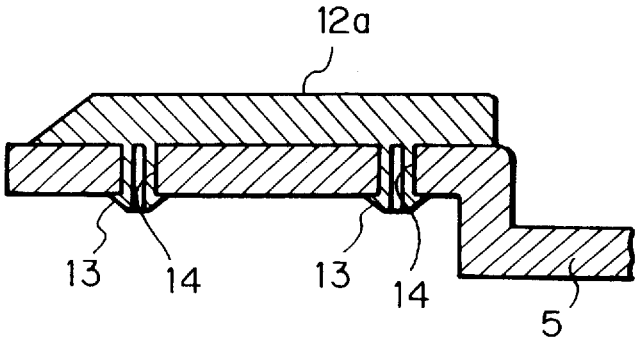
FIG. 3 is a vertically sectioned fragmentary side elevation showing an alternative embodiment of the present invention.

Reference will be made to FIG. 3 for describing an alternative embodiment of the present invention. As shown, a sheet sustaining portion 12*a* is removably mounted to the bottom of the tray 5. The sustaining portion 12*a* includes lugs 13 while the tray 5 is formed with holes 14 in its bottom. The sustaining portion 12*a* is affixed to the tray 5 with the lugs 13 resiliently received in the holes 14.

The sustaining portion 12*a* is mounted to the bottom of the tray 5 when the sheets 6 to be stacked on the bottom plate 7 has a relatively large size. The underside of the lowermost sheet 6 of such a size is brought into contact with and sustained by the sustaining portion 12. In this condition, the load of the stack 6 on the bottom plate 7 partly acts on the sustaining portion 12, so that the load acting on the bottom plate 7 decreases despite the number of sheets 6 existing on the plate 7. As a result, the bottom plate 7 and stack 6 are held in a substantially horizontal position contrastive to the sunk position discussed with reference to FIG. 1B. This also insures stable sheet feed even during continuous sheet feed as in the previous embodiment.

When the sheets 6 to be stacked on the bottom plate 7 are of relatively small size, the sustaining portion 12*a* is moved from the bottom of the tray 5. This is because the load of the sheets 6 of such a size acting on the bottom plate 7 is light enough to prevent the bottom plate 7 and stack 6 from sinking. In addition, because the sustaining portion 12*a* is absent, the stack 6 on the bottom plate 7 is not pressed against or deformed by the portion 12*a*.

Figure 4A:
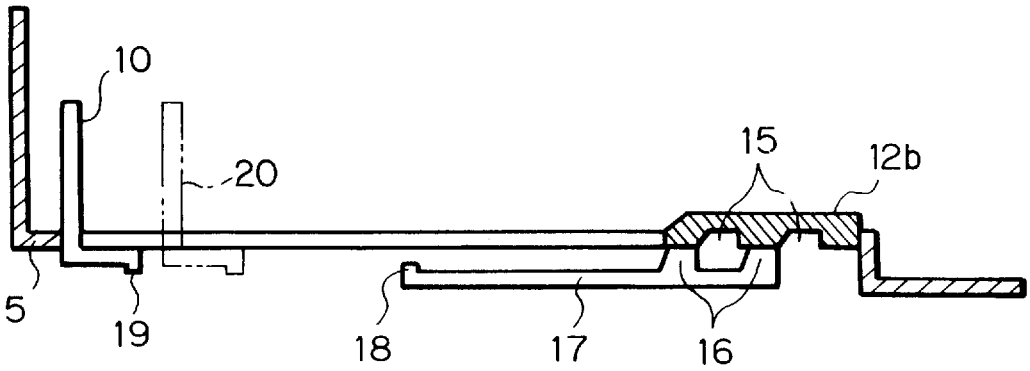
FIGS. 4A and 4B are vertically sectioned side elevations each showing another alternative embodiment of the present invention in a particular condition.
Figure 4B:
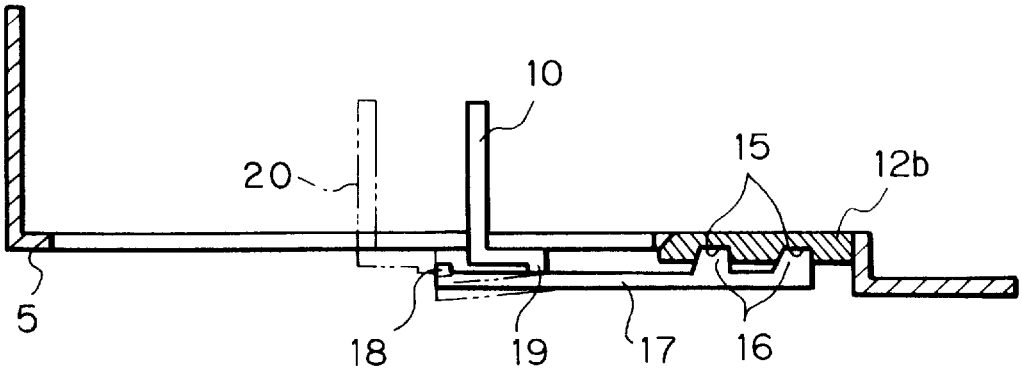

FIGS. 4A and 4B show another alternative embodiment of the present invention. As shown, a sheet sustaining portion 12*b* is mounted on the bottom of the tray 5 in such a manner as to be movable up and down. Specifically, the sustaining portion 12*b* is formed with recesses 15 in its bottom. A slider or adjusting plate 17 is positioned below the sustaining member 12*b* and formed with lugs 16 capable of mating with the recesses 15. The slider 17 is slidable back and forth in the direction of sheet feed within a preselected range. The rear end portion of the slider 17 in the direction of sheet feed is elastically deformable in the up-and-down direction and terminates at a projection 18. The end fence 10 slidable in the direction of sheet feed has a projection or pressing portion 19 at its front end in the above direction. The projection 19 abuts against the projection 18 and presses it downward when the end fence 10 is slid, as will b e described specifically hereinafter.

In FIG. 4A, the end fence 10 is shown in a position corresponding to a maximum sheet size (solid line) and a position corresponding to size A3 (dash-and-dots line). In these positions, the projection 19 of the end fence 10 does not abut against the projection 18 of the slider 17. Therefore, the slider 17 is held in its rearmost position in the direction of sheet feed. The lugs 16 of the slider 17 face the portions of the sustaining portion 12*b* other than the recesses 15 in the up-and-down direction. Consequently, the sustaining portion 12*b* is held in its raised position or operative position protruding from the tray 5.

FIG. 4B shows the end fence 10 in a position corresponding to a sheet size smaller than a preselected size. When the end fence 10 is slid to the position shown in FIG. 4B, the projection 19 abuts against the projection 18. Just after the abutment, the slider 17 slides forward together with the end fence 10. When the lugs 16 of the slider 17 align with the recesses 15 of the sustaining portion 12*b* in the up-and-down direction, the movement of the slider 17 is stopped. Subsequently, when the end fence 10 is slid further forward, it causes the portion of the slider 17 including the projection 18 to warp downward. As a result, the end fence 10 slides forward with its projection 19 getting over the projection 18. When the slider 17 is slid forward to the position shown in FIG. 4B, as stated above, the recesses 15 mate with the lugs 15 with the result that the sustaining portion 12*b* is lowered to an inoperative position for cancelling the sustainment.

The slider 17, projection 18 included in the slider 17 and projection 19 included in the end fence 10 constitute an interlocking mechanism 20. The interlocking mechanism 20 moves, in response to the movement of the end fence 10, the sustaining portion 12*b* from the operative position shown in FIG. 4A to the inoperative position shown in FIG. 4B.

The side fences 9 and end fence 10 are slid to their positions matching the size of the sheets 6 stacked on the bottom plate 7. Assume that the end fence 10 is brought to the position corresponding to the maximum size indicated by the solid line in FIG. 4A or to the position corresponding to size A3 indicated by the dash-and-dots line in FIG. 4A. Then, the projection 19 of the end fence 10 and the projection 18 of the slider 17 do not contact each other. In this condition, the recesses 15 and lugs 16 do not align with each other in the up-and-down direction. Therefore, the sustaining portion 12*b* remains in its operative position, sustaining the stack 6 existing on the bottom plate 7. In the operative position, the sustaining portion 12*b* allows the pick-up roller to feed sheets stably for the reason stated previously.

Assume that the end fence 10 is slid to the position corresponding to the sheet size smaller than the preselected size, as shown in FIG. 4B. In this case, the end fence 10 moves the slider 17 forward until the lugs 16 face the recesses 15 in the up-and-down direction and mate with the recesses 15. As a result, the sustaining portion 12*b* is lowered to its inoperative position spaced from the bottom of the stack 6. This prevents the sustaining portion 12*b* from pressing and deforming the stack 6.

When the end fence 10 is slid rearward from the position indicated by a solid line in FIG. 4B, the projection 19 hitches the projection 18 with the result that the fence 10 slides the slider 17 rearward to the positions shown in FIG. 4A. After the slider 17 has reached the position shown in FIG. 4A, the end fence 10 is slid further rearward while bending the portion of the slider 17 including the projection 18 downward. As a result, only the end fence 10 is moved rearward to the position shown in FIG. 4A with the projection 19 getting over the projection 18.

In summary, it will be seen that the present invention provides a sheet feeding device for an image forming apparatus and having various unprecedented advantages, as enumerated below.

(1) The device includes a sheet sustaining portion for sustaining a stack of sheets loaded on a bottom plate. Even when a great number of sheets are stacked on the bottom plate, the sustaining portion reduces a load to act on the bottom plate and thereby prevents the bottom plate and sheets from sinking. This allows a pick-up roller to press the sheet stack with an adequate force and feed the sheets stably.

(2) When the sheets on the bottom plate are of relatively large size and exert a heavy load on the bottom plate, the sustaining portion is moved to its sustaining or operative position in order to insure the stable sheet feed of the pick-up roller, as stated above. On the other hand, when the sheets are of relatively small size and exert only a light load on the bottom plate, the sustaining portion is retracted to its non-sustaining or inoperative position because the bottom plate and sheets do not sink. In the inoperative position, the sustaining member is prevented from pressing and deforming the sheet stack.

(3) When an end fence is moved to a position matching a sheet size, the sustaining portion is automatically moved to the operative position or the inoperative position with ease.

Various modifications will become possible for those skilled in the art after receiving the teachings of the present disclosure without departing from the scope thereof.

What is claimed is:

1. A sheet feeding device comprising:

a tray;

a bottom plate mounted on said tray and rotatable in an up-and-down direction configured to receive a stack of sheets;

a pick-up roller configured to press against an uppermost sheet of the stack for feeding said uppermost sheet;

an elevating mechanism configured to raise said bottom plate as a number of the sheets on said bottom plate decreases; and a sheet sustaining portion configured to contact and sustain a surface of a lowermost sheet of the stack which contacts said bottom plate, said sheet sustaining portion being located at substantially a center in a widthwise direction of the sheets in the vicinity of a center of rotation of said bottom plate.

2. A device as claimed in claim 1, wherein said sheet sustaining portion is movable between an operative position for sustaining the lowermost sheet and an inoperative position for cancelling sustainment.

3. A sheet feeding device comprising:

a tray;

a bottom plate mounted on said tray and rotatable in an up-and-down direction configured to receive a stack of sheets;

a pick-up roller configured to press against an uppermost sheet of the stack for feeding said uppermost sheet;

an elevating mechanism configured to raise said bottom plate as a number of the sheets on said bottom plate decreases; and a sheet sustaining portion configured to contact and sustain a lowermost sheet of the stack, said sheet sustaining portion being located at substantially a center in a widthwise direction of the sheets in the vicinity of a center of rotation of said bottom plate;

wherein said sheet sustaining portion is movable between an operative position for sustaining the lowermost sheet and an inoperative position for cancelling sustainment;

an end fence slidably disposed in said tray for positioning a rear end of the sheets in an intended direction of sheet feed, and an interlocking mechanism for moving aid sheet sustaining portion between said operative position and said inoperative position in interlocked relation to a sliding movement of said end fence.

* * * * *